United States Patent [19]

Rogge et al.

[11] Patent Number: 4,896,600

[45] Date of Patent: Jan. 30, 1990

[54] PRINTING MACHINE

[75] Inventors: Dieter Rogge, Lengerich; Robert Blom, Tecklenburg; Wolfgang Knapheide, Lienen, all of Fed. Rep. of Germany

[73] Assignee: Windmoller & Holscher, Lengerich, Fed. Rep. of Germany

[21] Appl. No.: 282,242

[22] Filed: Dec. 9, 1988

[30] Foreign Application Priority Data

Dec. 11, 1987 [DE] Fed. Rep. of Germany ..... 3742129

[51] Int. Cl.[4] ..... B41E 5/16

[52] U.S. Cl. ..... 101/182; 101/247; 101/248

[58] Field of Search ..... 101/174, 178, 182, 139, 101/140, 247, 248, 209, 144, 145, 184, 185, 485, 486, DIG. 41

[56] References Cited

U.S. PATENT DOCUMENTS

| | | | |
|---|---|---|---|
| 3,604,350 | 9/1971 | Rosenstadt | 101/182 |
| 3,800,698 | 4/1974 | Kist et al. | 101/247 |
| 4,231,292 | 11/1980 | Stolle | 101/247 |
| 4,309,945 | 1/1982 | Marion | 101/248 |
| 4,413,560 | 11/1983 | Rogge | 101/247 |
| 4,602,562 | 7/1986 | Ottenhues | 101/182 |
| 4,833,982 | 5/1989 | Liebert et al. | 101/182 |

*Primary Examiner*—Eugene H. Eickholt

*Attorney, Agent, or Firm*—Fleit, Jacobson, Cohn, Price, Holman & Stern

[57] ABSTRACT

A printing machine, such as a flexographic printing machine has a plurality of inking units and a plurality of plate cylinders. A central gear drives an impression cylinder and during a printing operation meshes with plate cylinder gears. The plate cylinders are mounted on plate cylinder carriages on tracks included in the machine frame and which are movable towards the impression cylinder for a printing operation. Halftone ink roller gears are associated with halftone rollers of the inking units and mesh with the plate cylinder gears. The halftone rollers are movable on inking unit carriages on tracks on the plate cylinder carriages. The teeth of the central gear are to be aligned with the teeth of the plate cylinder gears when the latter teeth are moved to pushed-in positions. The plate cylinder gears are provided with datum marks with which sensors fixed to the inking carriage cooperate so that the plate cylinders can be aligned for printing in register. To ensure that an adjustment for printing in register can be effected with high accuracy, without errors and without a need for manual work, each plate cylinder gear is equipped with a servomotor which rotates the plate cylinder gear to a position in which the respective sensor detects the respective datum mark.

14 Claims, 6 Drawing Sheets

PRINTING MACHINE

BACKGROUND OF THE INVENTION

1. Field of the Invention

This invention relates to a printing machine, such as a flexographic printing machine, of the type comprising a plurality of inking units, a plurality of plate cylinders and at least one impression cylinder which, during a printing operation, is driven by a central gear in mesh with plate cylinder gears. The plate cylinders are mounted on plate cylinder carriages, on tracks included in the machine frame, and which extend in approximately tangential to radial directions relative to the central gear. The plate cylinders are movable into engagement with the impression cylinder for the printing operation and are movable away from the impression cylinder. The inking units comprise halftone rollers, which carry halftone roller gears in mesh with the plate cylinder gears, and the halftone rollers are movable by inking unit carriages on tracks of the plate cylinder carriages. The machine also has means for aligning the teeth of the central gear with the teeth of the plate cylinder gears when the latter have been moved to pushed-in positions, datum marks provided on the plate cylinder gears and feelers, secured to the carriages for cooperating with the datum marks, for ensuring that the plate cylinders are properly aligned or adapted to be aligned for printing in register.

2. Description of the Prior Art

In a flexographic printing machine, the plate cylinders generally must be changed after each print job and the printing format may also have to be changed. The number of plate cylinders to be changed will depend on the number of colors to be printed. For each print job the plates of the plate cylinders must be properly adjusted relative to each other so that a web moving through the machine will be printed in register. To ensure printing in register, it is necessary to establish accurate meshing between the plate cylinder gears and the central gear. It is also desirable that printing be resumed after as short as possible a change-over time and that prolonged downtimes of expensive printing machines be avoided to the extent possible.

In a printing machine of the kind hereinbefore described and disclosed, for example, in published German Pat. Application No. 34 37 216, the need for expensive adjusting work after a changeover of the printing machine is substantially eliminated. A certain amount of adjusting work however, must still be performed by hand in the known machine, because the gears for driving the plate cylinders must be rotated by hand until the feeler, consisting of a lever, snaps into the associated datum mark, which is constituted by a setting bore.

SUMMARY OF THE INVENTION

It is an object of the present invention to provide a multicolor printing machine of the kind described with register preadjusting means for adjusting the machine for printing in register with high accuracy substantially without errors and without the need for manual adjustments.

In accordance with the invention, a respective plate cylinder gear is adapted to be coupled to a gear which is connected to a servomotor for moving the plate cylinder gear to a position in which the feeler senses the datum mark.

The servomotor may be controlled by a control device, which causes the servomotor to operate until the feeler has detected the mark. This can be accomplished in two ways. The mark may either define the proper position for the plate cylinder gear for printing or may alternatively define a zero position from which the plate cylinder gear must be rotated by the servomotor through an appropriate angle to position the plate cylinder in the proper position for printing.

If the mark is itself to define the proper position of the plate cylinder for printing, the mark must be provided after the machine has been set up and the plates have been secured. If the mark is to define the proper printing position of the plate cylinder, care must be taken during a change-over or adjusting operation always to install each plate cylinder in the appropriate print unit, because the plate cylinders should not be interchanged in this case.

On the other hand, if the mark only defines the zero position, so that the mark is aligned with the plate in a predetermined manner, the plate cylinders can be installed in any one of the print units, and when a plate cylinder has been adjusted to its zero position, the associated plate cylinder gear is rotated to move the plate cylinder to the proper position for printing. For this reason, according to a further feature of the invention, the servomotor may be controlled by an electronic computer, which causes the servomotor to operate until the plate cylinder concerned has been moved from the zero position, defined by the mark, to the proper position for printing. This feature eliminates the need for additional change-over times because it is not necessary during a change-over to take care that a respective plate cylinder will be installed into a specific print unit. The computer-controlled servomotor will first effect a movement to the zero position, in which the feeler detects the mark, and in accordance with a program entered into the computer, the plate cylinder gear is then rotated through an appropriate angle to position the plate cylinder gear in the proper meshing position relative to the central gear.

In accordance with a further feature of the invention, the gear for driving the plate cylinder gear from the servomotor may be the halftone roller gear or ink roller gear, and the ink roller shaft may be adapted to be coupled to the servomotor.

A further consideration resides in that the gears of the ink roller and of the plate cylinder should be adjusted relative to each other in such a manner that the top lands of their respective teeth will not strike against each other, but rather that the gears will properly mesh with each other when the inking unit carriage is moved toward the plate cylinder.

In accordance with a further feature of the invention, a synchronizing gear is mounted on the ink roller shaft beside the ink roller gear. The synchronizing gear has teeth which are axially aligned with the teeth of the ink roller gear, and the addendum circle of the synchronizing gear is larger than the addendum circle of the ink roller gear. The synchronizing gear is radially movable against spring means from a position in which the synchronizing gear is concentric with the ink roller shaft. For an adjustment of the ink roller gears and plate cylinder gears, these gears are moved toward each other to a position in which their addendum circles are slightly spaced apart. In that position, the teeth of the synchronizing gear will either mesh with the teeth of the plate cylinder gear or the teeth of the synchronizing gear will strike against the teeth of the plate cylinder gear. In the latter case, the ink roller shaft is rotated through a small angle to cause the teeth of the synchronizing gear to snap into mesh between the teeth of the plate cylinder gear. Alternatively, the plate cylinder gear will be rotated through the small angle when the synchronizing gear has meshed with the plate cylinder gear. As a result, an adjustment is effected by a rotation through a small angle so that a second step may be performed in which the gears are moved toward each other until their teeth properly mesh with each other.

The plate cylinder gear is desirably axially slidably mounted on the plate cylinder shaft and means may be provided for displacing the plate cylinder gear between positions in which the plate cylinder gear is in mesh and out of mesh, respectively, with the synchronizing gear. In this case, it is simple to move the synchronizing gear to its effective and ineffective positions.

The feeler may suitably consist of a clearance-measuring proximity sensor. By axial displacement of the plate cylinder gear, the proximity sensor is moved to an activated position, in which the proximity sensor is responsive to marks provided on the plate cylinder gear and which suitably consist of bores. A marking bore is suitably provided on an end face of the plate cylinder gear within the dedendum circle, so that the bore can be properly detected.

The feeler or the proximity sensor is suitably mounted in a fixed position on the ink roller carriage.

The proximity sensor is suitably in its sensing position when the halftone roller gear has been displaced to a position in which it is in mesh with the plate cylinder gear, which position corresponds to the so-called impression-off position of the printing machine.

In accordance with a further feature of the invention, the ink roller gear may be adapted to be coupled by a clutch to a gear which is freely rotatably mounted on the ink roller shaft and which is operatively connected to the servomotor by a pinion or by gears. Before a printing operation is initiated, after the plate cylinder has been adjusted, the freely rotatable gear is uncoupled from the ink roller gear so that the former gear can rotate freely on the ink roller shaft while the servomotor is at a standstill.

In a further embodiment of the invention, gears provided with free-wheels are rotatably mounted on both stub shafts for the ink roller. One of the gears on each stub shaft is the halftone roller gear, adapted to be coupled to the respective stub shaft by a clutch. That one of the gears which is opposite to the halftone roller gear meshes with the output pinion of the servomotor directly or by means of idler gears. In this embodiment, the servomotor may be used to effect the required adjustment and in a second mode of operation, when the gears provided with the free-wheels have been coupled and uncoupled, respectively, the servomotor may be used to continue the drive of the ink roller in intervals between printing operations.

The clutches by which the gears provided with free-wheels are adapted to be coupled to the stub shafts carrying the halftone roller may consist of friction clutches, which are actuated by fluid-operably piston-cylinder units.

DESCRIPTION OF PREFERRED EMBODIMENTS

Illustrative embodiments of the invention will now be described in detail with reference to the drawings.

Figure 1:
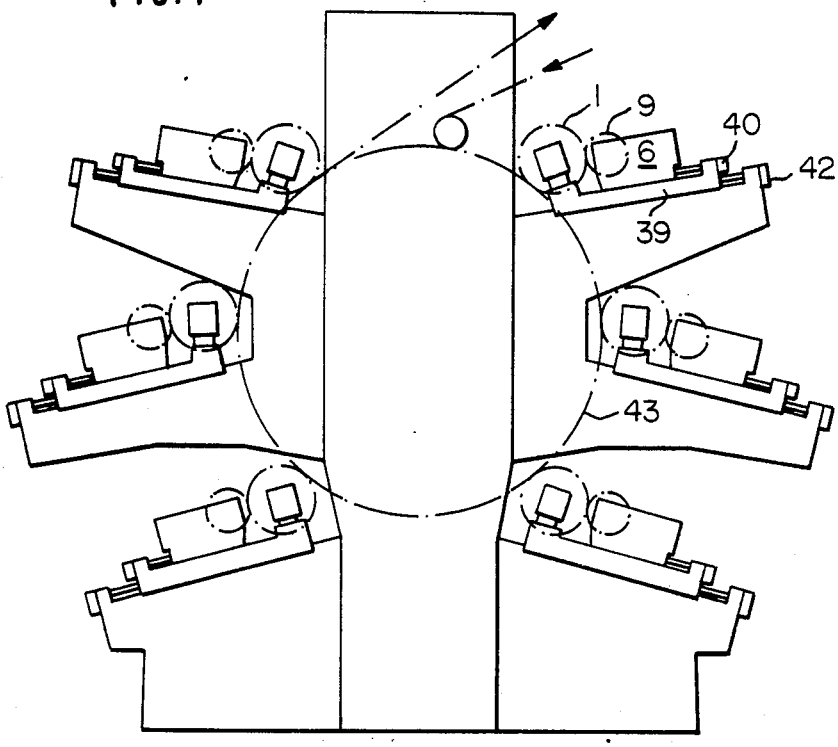
FIG. 1 is a diagrammatic side elevational view of a flexographic printing machine having multiple printing and inking units.
Figure 2:
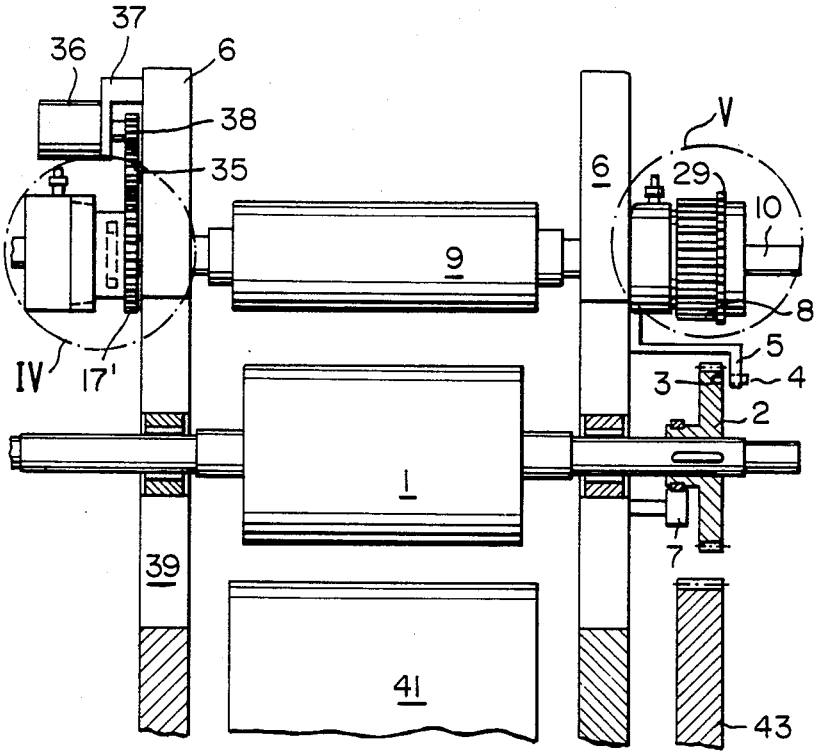
FIG. 2 is a plan view of the printing unit and inking unit shown in the top right-hand part of FIG. 1, with the plate cylinder gears and ink roller gears shown in an out-of-mesh position for clarity of illustration.

FIG. 2 shows an inking unit of the printing machine shown in FIG. 1, the inking unit being provided with a newly installed plate cylinder 1 and an associated plate cylinder gear 2. In its outer end face the plate cylinder gear 2 is formed within its dedendum circle with a bore 3, with which a proximity sensor 4 cooperates. The sensor 4 is secured to a holder 5, which is screw-connected to an ink roller bracket 6. An axial adjusting device 7 is provided, which is known per se and for this reason is not described in detail, and is operable axially to adjust the plate cylinder gear 2 relative to the plate cylinder 1 to such an extent that the plate cylinder gear 2 can be spaced an exactly defined distance from the proximity sensor 4. Such adjustable spacing corresponds to an activated position of the proximity sensor 4, i.e., to that position thereof in which the sensor 4 is able to detect the bore 3. To move the proximity sensor 4 to its active position, the bracket 6 mounting the ink roller 9 must be moved sufficiently closely to the plate cylinder 1, that the proximity sensor 4 laterally overlaps the gear 2 to a predetermined extent. Such overlap should be sufficiently large that the proximity sensor 4 radially protrudes over the root of the gear 2 but is not disposed on the radius on which the bore 3 is disposed. If the sensor is adjusted to reach the radius of the bore 3, the proximity initiator 4 may be exactly in the register, in dependence on the angular position, so that the depth of the bore may be effective to prevent a detection of the exact axial spacing.

An axial adjustment of the plate cylinder 1 is prevented by known means, not shown in detail, so that the plate cylinder gear 2 is axially displaced.

The radial distance left between the proximity sensor 4 and the marking bore 3 when the sensor is in the active position described above, corresponds to a so-called impression-off position of the printing machine, in which the pitch circle of the plate cylinder gear 2 is spaced from the pitch circle of a gear 8 for driving the ink roller 9. Thus the proximity sensor 4 will not be disposed on the radius of the bore 3 when the teeth of the plate cylinder gear and of the ink roller gear are loosely in mesh in a position which corresponds to the impression-off position.

As described above, a new plate cylinder 1 provided with an associated drive gear 2 has been installed into a bearing bracket 39 shown in FIG. 1. Also, the ink roller 9 and the ink, roller bracket 6 have been moved toward the plate cylinder 1 to such an extent that the proximity sensor 4, which is connected to the ink roller bracket 6 by the holder 5, overlaps the drive gear 2 to a predetermined extent. It is assumed that the drive gear 2 has been axially adjusted relative to the proximity sensor 4 by the adjusting means 7. By means of a motor 40, shown in FIG. 1, the ink roller bracket 6 is moved toward the plate cylinder 1 to such an extent that the addendum circles of the ink roller gear 8 and of the plate cylinder gear 2 are still slightly spaced from each other. A synchronizing gear 29 is mounted on a stub shaft 10 carrying the ink roller and is coaxial to the ink roller gear 8. Gear 29 has the same number of teeth as gear 8 but has an addendum circle which is larger than the addendum circle of gear 8. In an axial direction the teeth of the synchronizing gear 29 are so positioned relative to the teeth of the ink roller gear 8 that the teeth are mutually aligned. By known coupling and bearing means, the synchronizing gear 29 is mounted on the stub shaft 10 in such a manner that the gear 29 is non-rotatably connected to the stub shaft 10 but is radially displaceable.

Figure 4:
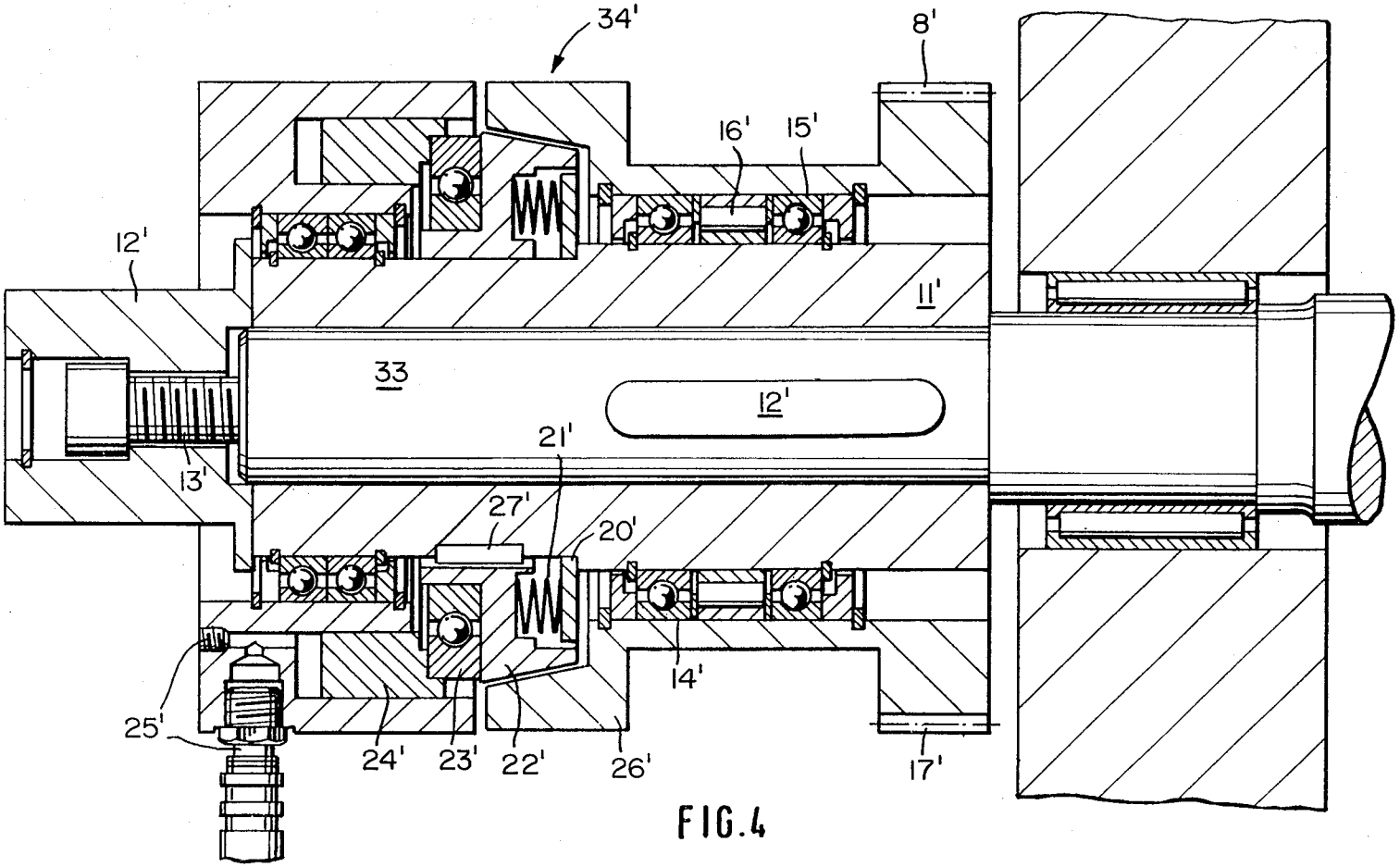
FIG. 4 is an enlarged view of the encircled portion designated IV in FIG. 2.
Figure 5:
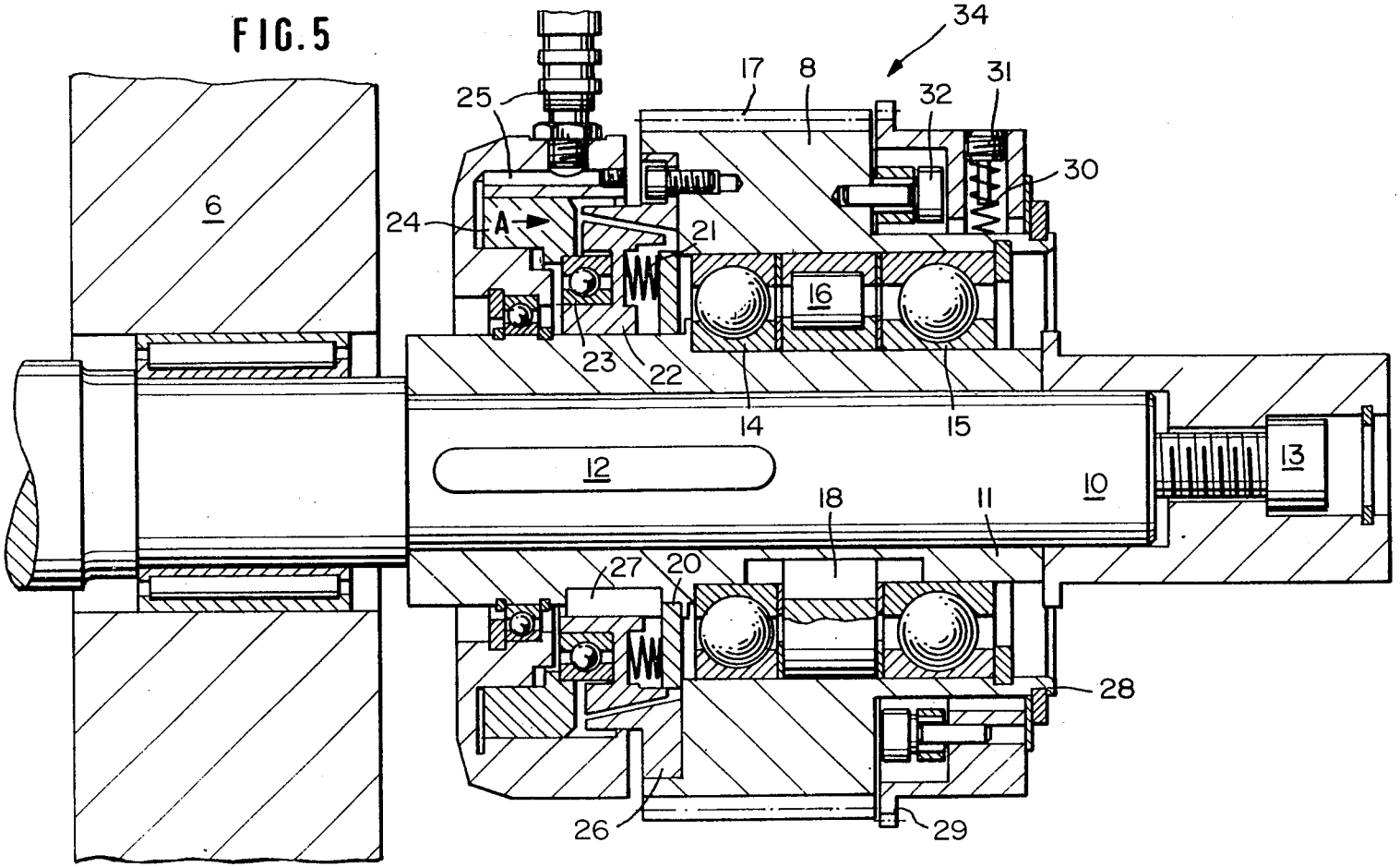
FIG. 5 is an enlarged view of the encircled portion designated V in FIG. 2.

When the ink roller gear 8 and the plate cylinder gear 2 are in the position which has been described above in which the addendum circles of the gears do not yet contact each other, the teeth of the synchronizing gear 29 will either mesh with the teeth of the plate cylinder gear 2, or else the top lands of the teeth of the synchronizing gear 29 will engage the top lands of the teeth of the plate cylinder gear 2. When the top lands of the respective teeth engage each other, the synchronizing gear 29 is radially shifted against the force of compression springs 30 (FIG. 5) of a mounting means which is known and therefore not described in detail. When this position is reached, two free-wheel assemblies 16, 16', shown in FIGS. 4 and 5, which normally allow gears 8, 8' to rotate on stub shafts 10, 33, are locked in that pressure fluid supplied compressed air is supplied through air supply passages 25, 25' to force clamping cones 22, 22' against the conical rings 26, 26', overcoming the action of springs 21, 21' which abut on plates 20, 20'. Cones 22, 22' are non-rotatably connected to stub shafts 10, 33 and rings 26, 26' are secured to gears 8, 8' so that a rigid connection is formed between the ink roller gears 8, 8', on the one hand, and the stub shafts 10, 33 and the ink roller 9, on the other hand. Cones 22, 22' are moved by pistons 24, 24' on which the compressed air acts. Thereafter, a stepping motor 36, shown in FIG. 2, is started for a first time to rotate shafts 10, 33 as will be described, so that the teeth of the synchronizing gear 29 are brought into mesh with the teeth of the plate cylinder gear 2 even when their top lands have previously engaged each other.

When the top lands of the gears 2 and 29 engage each other, the compression spring 30 included in the means for mounting the synchronizing gear 29 will exert on the latter only such a small force that the pressure applied by the synchronizing gear 29 to the teeth of the plate cylinder gear 2 is not sufficient for rotation of the plate cylinder 1 by friction. Also, even when the teeth of the synchronizing gear 29 already are properly in mesh with the teeth of the plate cylinder gear 2, this will not be harmful, because in that case the operation of the stepping motor 36 will rotate only the plate cylinder 1 to a certain extent. After a short actuation of the stepping motor 36, the synchronizing gear 29 will reliably be in mesh with the teeth of the plate cylinder gear so that the teeth of the ink roller gear 8 will be properly positioned relative to the teeth of the plate cylinder gear 2. As a result, the motor 40 shown in FIG. 1 can be used to move the ink roller bracket and the ink roller 9 toward the plate cylinder 1 to such an extent that the teeth of the ink cylinder gear 8 are brought loosely into mesh with the teeth of the plate cylinder gear. In that so-called impression-off position, the marking bore 3 of the plate cylinder 2 is disposed on the same radius as the proximity sensor 4. The bore 3 may then assume any desired angular position relative to the proximity sensor 4.

In the illustrative embodiment described above, a reference edge, i.e., leading edge of a block which has been adhered to the plate cylinder 1, lies in an axial plane with the marking bore 3. Thereafter, the stepping motor 36 is operated to rotate the plate cylinder 1 and the plate cylinder gear 2 until the proximity sensor 4 is adjacent to and detects the marking bore 3 of the plate cylinder gear 2. Because the several plate cylinders of each printing unit must assume a predetermined angular position relative to each other, the plate cylinder must be rotated further through a corresponding angle from the zero position defined by the marking bore. The extent through which a plate cylinder 1 must be rotated to assume the correct position in mesh with the central gear is controlled by an electronic computer. In accordance with a suitable program, the correct extent of the adjustment is stored in the computer, so that the latter controls the motor 36 for a rotation of the plate cylinder gear 2 and the plate cylinder to the correct position. The motor 36 suitably consists of a stepping motor so that the rotation of the plate cylinder 1 is then effected by a suitable number of steps. When said steps have been performed, the plate cylinder 1 is in the associated proper angular position relative to the impression cylinder 41. Previously, the impression cylinder 41 has been moved to a predetermined initial position by means not shown because they are known per se. The motor 42 shown in FIG. 1 is then operated to move the carriage 39 and the plate cylinder 1 together with the ink roller 9 toward the impression cylinder 41 and toward the central gear 43 associated with the impression cylinder 41 to such an extent that the teeth of the plate cylinder gear 2 loosely mesh with the teeth of the central gear 43 so that they are in the impression-off position. During the adjusting movement, the two annular pistons 24, 24' may be vented so that they are moved to their initial position by the springs 21, 21'. To ensure that the synchronizing gear 29 is not always in mesh with the plate cylinder gear 2, the latter is moved by axial adjusting means 7 toward the plate cylinder 1 until the synchronizing gear 29 is disposed beside the plate cylinder gear 2.

When all printing units have been properly adjusted, the main drive for the central gear 43 can be started. The rotation of the central gear 43 will be transmitted to the plate cylinder gears 2 and from the latter to the ink roller drive gears 8, which are connected by the free-wheels 16 to the stub shafts 10 to rotate the ink roller 9. That stub shaft 33 for the ink roller 9 which is opposite to the stub shaft 10 does not rotate with the latter. The free-wheel 16' ensures that the rotation is not transmitted to the gear 8', which is in mesh via an idler gear 35 with a pinion 38 of the stepping motor 36. In such state, the printing machine rotates in the so-called impression-off position. As the plate cylinder 1 is moved closer to the impression cylinder 41 and the ink roller 9 is moved closer to the plate cylinder 1, the impression-on position is assumed, i.e., the printing machine is now in its operating position. When a print job has been completed, the printing machine returns to its impression-off position and the main drive for the central gear 43 is turned off. In that position, care must be taken to continue the rotation of the ink roller 9 so that the ink will not dry. To that end, the stepping motor 36 is turned on again to rotate via its pinion 38 the idler gear 35, the gear 8', the free-wheel 16', and the stub shaft 33 so that the ink roller is kept in motion. In that case, the free-wheel 16 mounted on the stub shaft 10 ensures that the rotation of the stub shaft 10 is not transmitted to the drive gear 17. It is apparent that the respective free-wheel devices 16 and 16' can be actuated independently of one another dependent on which form of operation of the machine is required.

It is further apparent from the foregoing description that the stepping motor is used for effecting an exact positioning of the plate cylinder 1 and for effecting a continued rotation of the ink roller 9 when the printing machine is in the impression-off position. Because stepping motors can generally be operated at different speeds, this will afford the advantage that the continued rotation imparted to the ink rollers in the impression-off position can be effected at a speed which involves the smallest abrasion at the interface between a doctor blade and the ink roller.

In the apparatus which has been described above and shown in FIGS. 2, 4 and 5, the two stub shafts 10 and 33 carrying the ink roller are provided each with an adjusting device. In the embodiment shown in FIG. 3, a plate cylinder 1 can be adjusted 15 and an adjusting device 45 can be provided only on the right-hand stub shaft 10 carrying the ink roller 9.

Figure 3:
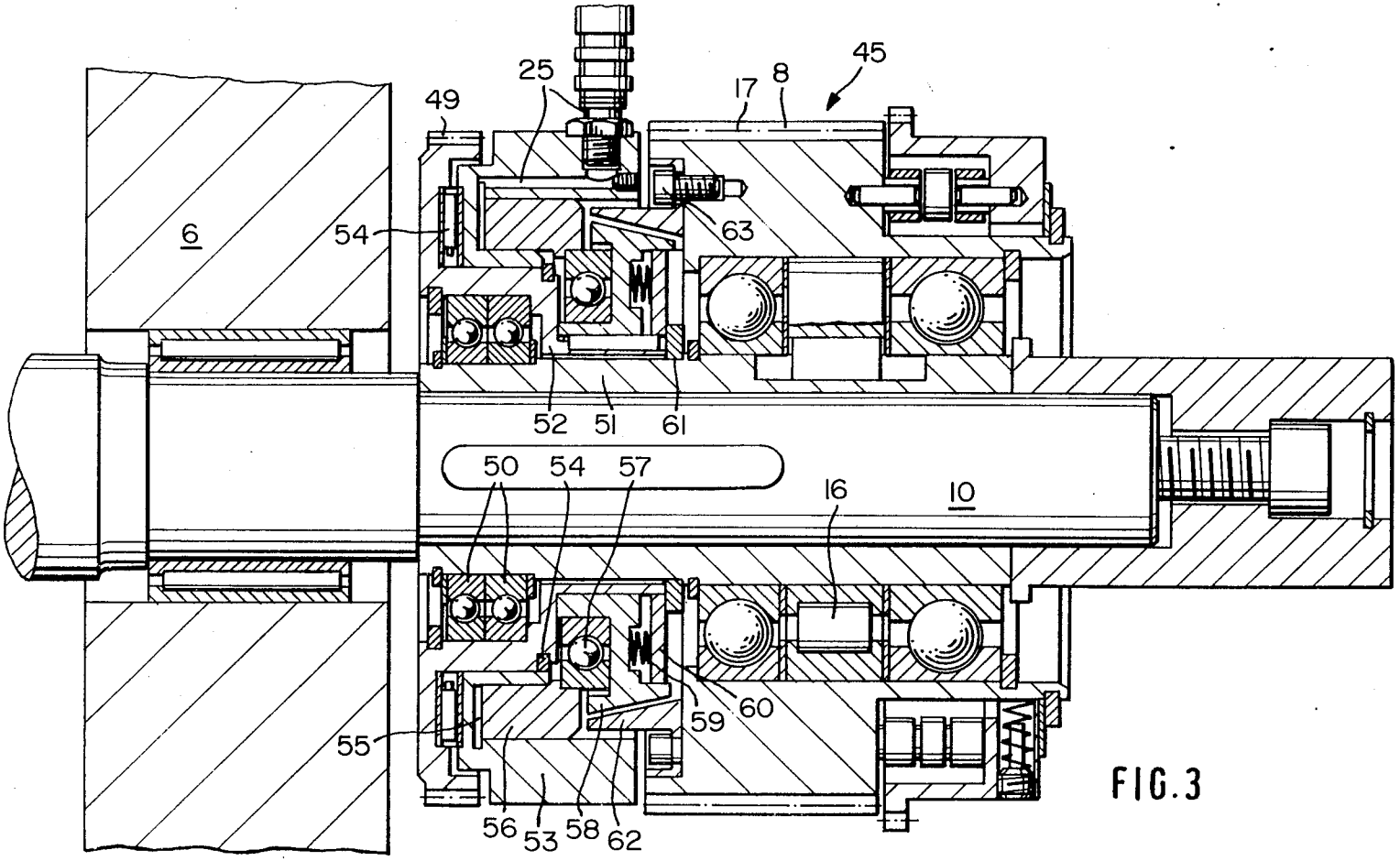
FIG. 3 is an enlarged view of the encircled portion labelled III in FIG. 7.
Figure 7:
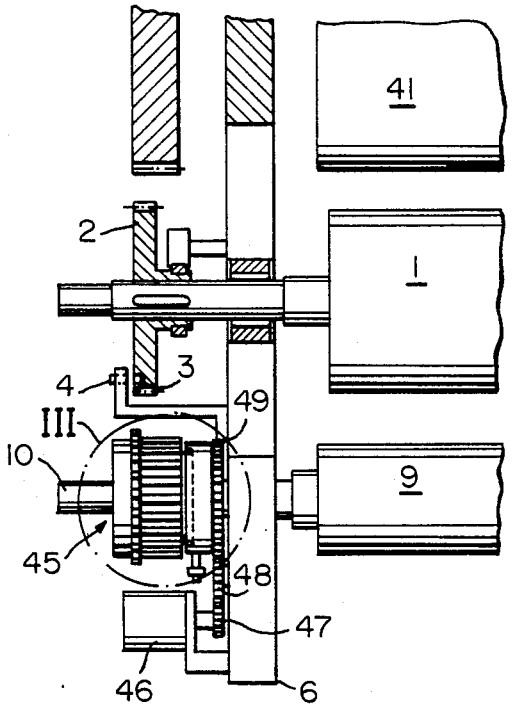
FIG. 7 is a plan view of the inking unit.

FIG. 7 shows a portion of FIG. 2 in an embodiment which has been modified in accordance with FIG. 3. It is apparent that a difference from FIG. 2 resides in that the ink roller bracket 6 is connected on the right to a stepping motor 46, a pinion 47 of which is in mesh via an idler gear 48 with a gear 49. The gear 49 is mounted by means of bearings 50 on sleeve 51. The flange 52 of the gear 49 is embraced by an intermediate ring 53, which is held against the end face of the gear 49 by means of a retaining ring 54, inserted into an annular recess of the flange 52, and with a thrust bearing 54' interposed. The intermediate ring 53 has a recess 55, which receives an annular piston 56, which by means of the bearing 57 bears on a clamping cone 58, which in an initial position is urged against the flange 52 of the gear 49 by a plurality of springs 59, which are spaced around the circumference. On that side opposite to the cone 58, the springs 59 bear on plate 60, which is supported by a disk 61 on a flange of the sleeve 51. A conical ring 62 is associated with the clamping cone 47, and corresponds to the two conical rings 26 and 26' shown in FIGS. 4 and 5. Because the design corresponds in other respects to that of the adjusting device 34 shown in FIG. 5, further details of the design of the adjusting device shown in FIG. 3 will not be described.

Regarding the operation of the embodiment described with reference to FIGS. 3 and 7, it is assumed that a new plate cylinder 1 has been installed and that the ink roller and the plate cylinder 1 have been moved toward each other to such an extent that the sensor 4 laterally overlaps the plate cylinder gear 2. This displacement operation is performed like that described hereinbefore with references to FIGS. 2, 4 and 5. When the spacing of the several cylinders and rollers has been adjusted, the plate cylinder 1 must be adjusted. To that end, compressed air is forced into the cylinder chamber 55 through the air supply line 25, so that the annular piston 56 and the bearing 57 effect a frictional coupling between the conical clamping cone 58 and the conical ring 62. The conical ring 62 is secured by screws 63 to the drive gear 17. The stepping motor 46 is then operated so that the adjusting operation is effected in the manner described with reference to FIGS. 2, 4 and 5. In the embodiment shown in FIGS. 3 and 7 the required continued rotation of the ink roller 9 in the impression-off position is not effected by the stepping motor but by a separate motor, not shown.

Figure 6:
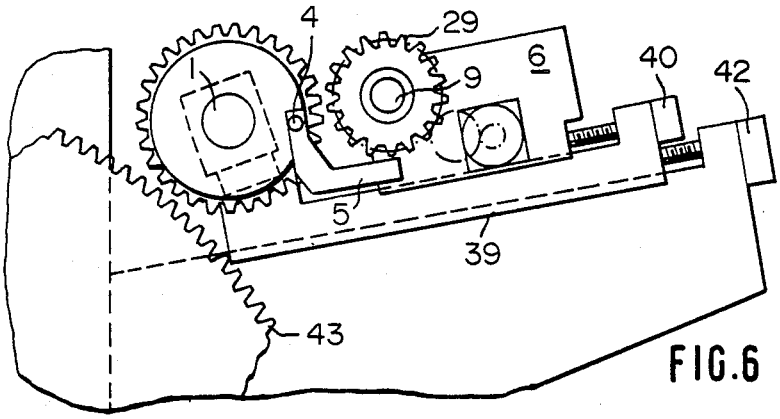
FIG. 6 is a side elevational view of an inking unit provided with a proximity sensor.

FIG. 6 is a side elevation showing on an enlarged scale an inking unit and indicates the position and arrangement of the sensor 4.

We claim:

1. A printing machine comprising a plurality of inking units, a plurality of plate cylinders, at least one impression cylinder, a central gear for driving the impression cylinder during a printing operation by meshing with plate cylinder gears associated with the respective plate cylinders, the plate cylinders being mounted on plate cylinder carriages on tracks included in a frame of the machine and which extend in approximately tangential to radial directions relative to the central gear, the plate cylinders being movable into engagement with the impression cylinder for the printing operation and away from said impression cylinder after printing, wherein the inking units comprise halftone ink rollers with ink roller shafts which carry halftone ink roller gears to mesh with the plate cylinder gears, and said halftone rollers being movable by inking unit carriages on tracks of the plate cylinder carriages, the machine further comprising means for aligning respective teeth of the central gear with teeth of the plate cylinder gears when the plate cylinder gears are moved to pushed-in positions, datum marks provided on the plate cylinder gears, feelers secured to respective ones of the carriages to cooperate with said marks in such a manner that the plate cylinders can be angularly aligned for printing in register, and a servomotor for angularly moving a respective plate cylinder gear, through drive gear means, to a position in which the feeler can sense the datum mark.

2. A printing machine according to claim 1, including an electronic computer for controlling the servomotor to operate until the respective plate cylinder has been moved from a zero position defined by the datum mark to a required position for printing.

3. A printing machine according to claim 1, wherein the drive gear means includes a respective ink roller gear and wherein an ink roller shaft associated with the ink roller gear is adapted to be coupled to the servomotor.

4. A printing machine according to claim 1, which includes a synchronizing gear mounted on a respective ink roller shaft adjacent a respective ink roller gear, the synchronizing gear having teeth aligned with the teeth of the ink roller gear, the synchronizing gear having an addendum circle larger than an addendum circle of the ink roller gear, and the synchronizing gear being radially movable against spring means out of a position in which the synchronizing gear is concentric with the ink roller shaft.

5. A printing machine according to claim 4, wherein a respective plate cylinder gear is axially slidably mounted on a respective plate cylinder shaft and means is provided for displacing the plate cylinder gear between positions in which the plate cylinder gear is in mesh and out of mesh, respectively, with the synchronizing gear.

6. A printing machine according to claim 1, wherein the feeler comprises a clearance-detecting proximity sensor.

7. A printing machine according to claim 1, wherein a respective proximity sensor is secured to a respective inking unit carriage.

8. A printing machine according to claim 1, wherein a respective mark consists of a bore in the respective plate cylinder gear.

9. A printing machine according to claim 8, wherein the respective bore is formed on one end face of the respective plate cylinder gear within a dedendum circle of the gear.

10. A printing machine according to claim 1, wherein the respective proximity sensor is in a sensing position when the respective halftone roller gear has been displaced to a position in which the halftone roller gear is in mesh with the plate cylinder gear, which position corresponds to an impression-off position of the machine.

11. A printing machine according to claim 1, which includes a clutch for selectively coupling a respective ink roller gear to a freely rotatably mounted gear on the ink roller shaft, and the rotatably mounted gear is operatively connected to the servomotor by a gear means.

12. A printing machine according to claim 1, which includes two gears provided with free-wheel assemblies rotatably mounted respectively on stub shafts carrying a respective ink roller, one of the said two gears being a respective halftone roller gear, clutches for coupling said two gears to the respective stub shaft and the other of said two gears having a gear drive connection with an output pinion of the servomotor.

13. A printing machine according to claim 12, wherein said clutches comprise friction clutches, and the machine includes fluid-operable piston-cylinder units for actuating the clutches.

14. A printing machine comprising a plurality of inking units, a plurality of plate cylinders, at least one impression cylinder, a central gear for driving the impression cylinder during a printing operation by meshing with plate cylinder gears associated with the respective plate cylinders, the plate cylinders being mounted on plate cylinder carriages on tracks included in a frame of the machine and which extend in approximately tangential to radial directions relative to the central gear, the plate cylinders being movable into engagement with the impression cylinder for the printing operation and away from said impression cylinder after printing, wherein the inking units comprise halftone ink rollers with ink roller shafts which carry halftone ink roller gears to mesh with the plate cylinder gears, and said halftone rollers being movable by inking unit carriages on tracks of the plate cylinder carriages, the machine further comprising means for aligning respective teeth of the central gear with teeth of the plate cylinder gears when the plate cylinder gears are moved to pushed-in positions, datum marks provided on the plate cylinder gears, feelers secured to respective ones of the carriages to cooperate with said marks in such a manner that the plate cylinders can be angularly aligned for printing in register, and a synchronizing gear mounted on a respective ink roller shaft adjacent the respective ink roller gear for engaging a respective plate roller gear prior to engagement of the respective ink roller gear with the plate roller gear, the synchronizing gear having teeth aligned with teeth of the ink roller gear, the synchronizing gear having an addendum circle larger than an addendum circle of the ink roller gear, and the synchronizing gear being radially movable against spring means out of a position in which the synchronizing gear is concentric with the ink roller shaft.

* * * * *